US005700756A

United States Patent [19]

Pack

[11] Patent Number: 5,700,756

[45] Date of Patent: Dec. 23, 1997

[54] THERMAL TRANSFER PRINTING DYESHEET

[75] Inventor: Barry Pack, Ipswich, United Kingdom

[73] Assignee: Imperial Chemical Industries PLC, United Kingdom

[21] Appl. No.: 556,983

[22] PCT Filed: May 27, 1994

[86] PCT No.: PCT/GB94/01154

§ 371 Date: Apr. 2, 1996

§ 102(e) Date: Apr. 2, 1996

[87] PCT Pub. No.: WO94/29116

PCT Pub. Date: Dec. 22, 1994

[30] Foreign Application Priority Data

Jun. 16, 1993 [GB] United Kingdom ..... 9312351

[51] Int. Cl.[6] ..... B41M 5/035; B41M 5/38

[52] U.S. Cl. ..... 503/227; 428/195; 428/323; 428/331; 428/336; 428/488.4; 428/500; 428/704; 428/913; 428/914

[58] Field of Search ..... 8/471; 428/195, 428/323, 331, 488.4, 913, 914, 500, 336, 704; 503/227

[56] References Cited

FOREIGN PATENT DOCUMENTS

| | | |
|---|---|---|
| 0 295 483 | 12/1988 | European Pat. Off. . |
| 0 314 348 | 5/1989 | European Pat. Off. . |
| 0 458 522 | 11/1991 | European Pat. Off. . |

*Primary Examiner*—Bruce H. Hess

[57] ABSTRACT

A dyesheet for thermal transfer printing comprising a thermoplastic substrate film supporting a dyecoat containing a thermal transfer dye on one surface and a heat resistant backcoat on the other, wherein the backcoat comprises the following components:

a) a crosslinked polymeric binder having a thickness t and containing therein a combination of b) lubricating particles and c) load-bearing particles having an average diameter greater than t, and the haze value is less than 12%.

16 Claims, No Drawings

THERMAL TRANSFER PRINTING DYESHEET

The invention relates to dyesheets for forming printed images on receiver sheets by thermal transfer of dyes, using such heating means as thermal heads controlled by electronic image signals; and in particular to heat resistant backcoats therefor.

Thermal transfer printing is a process for generating printed images by transferring thermally transferable dyes from a dyesheet to a receiver. The dyesheet comprises a base sheet coated on one side with a dyecoat containing one or more thermally transferable dyes, and printing is effected while the dyecoat is held against the surface of the receiver, by heating selected areas of the dyesheet so as to transfer the dyes from those selected areas to corresponding areas of the receiver. This generates an image according to the areas selected. By repeating the transfer process with dyesheets of the three primary colours, full colour images can be obtained. Further panels, e.g. black, may also be provided.

Thermal transfer printing using a thermal head with a plurality of tiny heaters to heat the selected areas, has been gaining widespread attention in recent years, mainly because of its ease of operation in which the areas to be heated can be selected by electronic control of the heaters (e.g. according to a video or computer-generated signal), and because of the clear, high resolution images which can be obtained in this manner.

The base sheet of a thermal transfer dyesheet is usually a thin thermoplastic film, generally orientated polyester film on account of its superior surface smoothness and good handling characteristics. The thermoplastic materials used in such films, however, may lead to a number of problems. For example, for high resolution printing at high speed, it is necessary to provide the thermal stimulus from the heaters in pulses of very short duration to enable all the rows to be printed sequentially within an acceptably short time, but this in turn requires higher temperatures in the printer head in order to provide sufficient thermal energy to transfer sufficient dye in the time allowed. Such temperatures may be well in excess of the melting or softening temperatures of the thermoplastic base sheet, typically rising to 300°–400° C. during pulses of a few milliseconds. One adverse effect of such high temperatures can be localised adhesion between the dyesheet and the printer head, with a result that the dyesheet is unable to be moved smoothly through the printer, and in severe cases the base sheet can lose its integrity, with tearing of the dyesheet resulting.

These problems are usually addressed by providing the dyesheet with one or more protective backcoats of various heat-resistant, highly crosslinked, polymers. By "backcoats" in this context we mean coatings applied either directly or indirectly on the base sheet surface remote from that to which the dyecoat is applied. Thus it is to the backcoat side to which heat is applied by the thermal head during printing. In addition to providing a heat resistant layer to combat sticking, backcoats may also be formulated to improve slip and handling properties.

Poor slip and handling properties can lead to printing defects such as ribbing, and smiles. "Ribbing" is the appearance of lines transverse to the movement through the printer, which normally extend the full width of the print. They are formed by longitudinal variation in the optical density of the print, and occur when there are variations in the amount by which the dyesheet and receiver feed through the printer after each row of pixels has been printed. "Smiles" are short, usually curved, transverse lines caused by creasing of the dyesheet as it passes though the printer.

These problems have previously been attacked by adding heat resistant particles to stand proud of the binder surface, together with one or more lubricants and/or surfactants, but inappropriate slip/handling additives can also lead to the printed image having low colour density, streaks and/or indentations in the direction of travel of the receiver sheet through the printer, often referred to as "scratching", from its appearance.

Compositions of backcoats comprising crosslinked binders containing a combination of load bearing particles with lubricants and/or surfactants, are found for example in EP-A-314,348, which describes the use of talc particles with long alkyl chain lubricants such as zinc and lithium stearates and a surfactant, and EP-A-458,522 which similarly uses talc particles and surfactant, but with salts of long chain alkyl esters of phosphoric acid such as zinc stearyl phosphate. The specific embodiments exemplified in these two publications comprised binders containing variously about 9–17% by weight of the additives. EP-A-329,117 gives long lists of widely differing types of compounds from which the particles and the lubricant/surfactants respectively may be selected, and the Examples describe several very different compositions, including one using particles of polymethyl silsesquioxane (Tospearl 120) with a silicone surfactant (NUC silicone L7602) at a combined level of about 27% by weight of the binder resin. The use of large spherical particles such as Tospearl 120, is also described in EP-A-411,642, but in combination with mineral particles less than 10% the size of the large particles.

From the many end diverse compositions that have previously been proposed, the above examples of prior art have been selected with hindsight of the present invention, there being also a wealth of other proposed compositions that use additives different from those employed here. Also, in an earlier copending application, EP-A-547,893, we have described dyesheet backcoats of crosslinked acrylic binders containing a combination of polymethyl silsesquioxane particles and a particulate salt of a higher fatty acid or higher fatty acid phosphate, the specific embodiments containing the additives in amounts of about 11% by weight of the binder, or higher. That new combination of selected binder, load bearing particles and lubricant particles provided an unexpectedly good balance of slip and handling properties without the scratching and long term storage stability problems associated with some other previously proposed combinations.

However, we have noticed that at least some of the above dyesheets are not totally compatible with some, but certainly not all, commercially available printers, which then fail to operate consistently. We have now traced this to haze in the backcoat scattering light from sensors in the printers and causing them not consistently to detect location marks and/or dye sequence changes in the dyecoat. (As a measure of haze in this context, we use a Gardner XL 211 Hazeguard System, and the values quoted for haze herein are the values obtained or obtainable by this system.)

According to the present invention a dyesheet for thermal transfer printing comprises a thermoplastic substrate film supporting a dyecoat containing a thermal transfer dye on one surface and a heat resistant backcoat on the other, wherein the backcoat comprises the following components:

a) a crosslinked polymeric binder having a thickness t and containing therein a combination of b) lubricating particles and c) load-bearing particles having an average diameter greater than t, and the haze value is less than 12%.

A wide variety of highly crosslinked polymer compositions have previously been proposed for backcoat binders (component a), but for achieving low haze in the backcoat when using the particulate solids (components b & c) described in detail hereinafter, we prefer to use crosslinked acrylic compositions based on one or more polyfunctional organic resins having from 2 to 8 pendent or terminal acrylic or methacrylic groups per molecule available for crosslinking. These may be applied as monomer or oligomer solutions to the base film surface, and thereafter crosslinked so as to form a strong heat-resistant layer.

Examples of polyfunctional acrylic compounds include 1,6-hexandiol di(meth)acrylate (the designation "(meth)" being used herein to indicate that the methyl group is optional), ethylene glycol di(meth)acrylate, trimethylol propane tri(meth)acrylate pentaerythritol tri(meth)acrylate, pentaerythritol tetra(meth)acrylate, and dipentaaerythritol hexa(meth)acrylate, and esters of (meth)acrylic acid with polyester polyols and polyether polyols which are obtainable from a polybasic acid and a polyfunctional alcohol, urethane (meth)acrylates obtained through e reaction of a polyisocyanate and an acrylate having a hydroxy group, and epoxy acrylates obtained through a reaction of an epoxy compound with acrylic acid, an acrylate having a hydroxy group or an acrylate having a carboxyl group.

These polyfunctional resins can be used in combination with linear organic polymers, which do not copolymerise with them during crosslinking but which have an effect on the physical properties of the coating. Examples include polymethylmethacrylate and polyvinylchloride.

Instead or in addition to the linear organic polymers, the polyfunctional acrylic resins can be copolymerised with at least one organic compound having a single acrylic or methacrylic group per molecule.

Examples of suitable monofunctional compounds include such aliphatic (meth)acrylates as 2-ethylhexyl (meth) acrylate and lauryl (meth)acrylate, such alicyclic (meth) acrylates as cyclohexyl (meth)acrylate, isobornyl (meth) acrylate, dicyclopentanyl (meth)acrylate, and dicyclopentadienyl (meth)acrylate, such alkoxyalkylene glycol (meth)acrylates as methoxydiethylene glycol acrylate, and ethoxydiethylene glycol acrylate, such aromatic (meth)acrylates as phenyl acrylate, and benzyl acrylate, and such (meth)acrylates of aliphatic alcohols as 2-hydroxyethyl (meth)acrylate, and 2-hydroxyethyl di(meth)acrylate. Of these, compounds having at least one alicyclic group per molecule are particularly favoured because of their low shrinkage characteristics, their resistance to migration of the dye from dyecoat to backcoat during storage end because they give coatings with good heat resistance.

Backcoats are preferably as thin as possible conducive with their providing sufficient thermal protection and handling properties, in order to minimise dissipation of the heat from the thermal head. This can be severe at 2.5 μm for high resolution prints, and we prefer the binder thickness to be not more than 2 μm. Most presently known binder compositions require minimum binder thicknesses of 0.4 μm for adequate protection, but the present haze and particle size criteria should still be equally valid for thinner compositions were these to become feasible.

Preferred lubricating particles (component b) are carboxylic or phosphoric acids, acid amides, esters and their multivalent metal salts, with at least one $C_{12-30}$ alkyl chain. Examples include particles of stearic acid and its multivalent metal salts, especially calcium stearate, magnesium stearate, zinc stearate and aluminium stearate, stearamide, behenic acid and its multivalent metal salts, especially calcium behenate, magnesium behenate, zinc behenate and aluminium behenate. Other examples include multivalent metal salts of phosphate esters expressed by the following general formula (A) and (B):

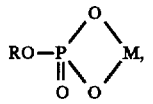

(A)

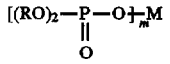

(B)

in which R is an alkyl group of $C_{12-30}$ or an alkylphenyl group, m is an integral number of 2 or 3, and M a metal atom. Preferred examples of such salts include zinc stearyl phosphate, zinc lauryl phosphate, zinc myristyl phosphate, calcium stearyl phosphate, magnesium stearyl phosphate, barium stearyl phosphate, aluminium stearyl phosphate, aluminium lauryl phosphate and aluminium tridecyl phosphate.

We find that components b and c both contribute to haze values, and that the larger the size of particles used, the greater tends to be the resultant haze. The smallest lubricant particles (component b) that we have been able to obtain, have produced lubrication not detectably worse than that produced by the larger particles (indeed they have generally appeared to provide enhanced lubrication), but the haze values do tend to be noticeably lower with the smaller particles, enabling larger amounts to be used for better printing properties but still with low haze. It appears that the smaller the size available, the better will be the result. We have used lubricants down in size to 0.2 μm with benefits, and sizes down at least to 0.1 μm seem preferable, with a common particle size of 2.5 μm providing a suitable upper limit above which haze values tend to intrude.

For the load-bearing particles (component c), we prefer to use spherical particles, examples of which include silsesquioxane compounds. The silsesquioxane structure means one wherein each of three bondings of a silicon atom are directly bound to oxygen atoms to form a three-dimensional crosslinked structure, wherein the single remaining bonding is substituted with a $C_{1-17}$ alkyl group which can be branched or unbranched, alkylsilyl group, silylalkyl group, aryl-substituted alkyl group, amino group, epoxy group, or vinyl group. Polymethyl silsesquioxane compounds that can readily be obtained include Tospearl 105, Tospearl 108, Tospearl 120, Tospearl 130, Tospearl 145 and Tospearl 240 (Toshiba Silicone products), and KHP-590 (Shinetsu Chemical product).

Other materials which can be used as load-bearing particles (component b) include silicone gel elastomers, commercially available examples of which include Torefil E 730S and Torefil E 500 (Toray Dow Corning products), and low surface energy particles such as polymers and copolymers of fluorinated alkenes, especially polytetrafluoroethylene (PTFE).

The size of the load bearing particles (component c) is governed by the need for these to stand proud of the backcoat resins, and average particle diameters of 1.2 t–2 t are preferred. However, particles as large as 4 t can be used without exceeding the above haze values, when used with particularly small lubricant particles (component b).

For minimum haze it is also desirable to use the least amount of the two sets of particles effective to give adequate slip and handling properties. We have now found that the above described lubricants and load bearing particles, when used in combination, enable lower particle levels to be used, while still retaining good slip end handling properties.

Proportions of the two species of particles together may be as low as 1.5% by weight of the binder when using the above preferred species of particles (b & c) in combination, without too much deterioration of the printing performance. However, both lubricating particles (b) and load bearing particles have important roles to play, and we prefer that each of the species of particles (b & c) are present as at least 0.5% by weight of the binder.

If the haze level is to be kept within the specified values, it is desirable to use not more the particles than 6% by weight of the binder, unless the lubricant particles predominate and have an average diameter less than about 1 μm, when an upper limit about 8% by weight of the binder may still provide a haze value within the limits specified herein.

The amounts of each of the two components need not be the same. Our preferred backcoat contains the lubricating particles (b) and load bearing particles (c) in the weight ratio (b:c) of 1:1 to 10:1. Where the ratio is 6:1 or greater, however, it is preferred that the lubricant particle size be about 1 μm or less.

A particularly preferred dyesheet for achieving such low haze values is one wherein the backcoat comprises a crosslinked polymeric binder (a) having a thickness t and containing therein a combination of lubricating particles (b) selected from at least one carboxylic or phosphoric acid, acid amide, ester and multivalent metal salts thereof, each having at least one $C_{12-30}$ alkyl chain and an average particle diameter of 0.1–2.5 μm; and load-bearing particles (c) which are at least one of spherical and elastomeric, with an average particle diameter of 1.2 t–2 t; and wherein the proportions by weight of components a, b and c are given by the formula: b+c/a=0.015 to 0.08.

According to a further aspect of the invention, there is provided a method of thermal transfer printing by transferring thermally transferable dyes from a dyesheet to a receiver using a printer having at least one sensor susceptible to excess haze in the dyesheet, wherein the dyesheet has a backcoat with a haze value of less than 12%, and comprises a crosslinked polymeric binder (a) having a thickness t and containing therein a combination of lubricating particles (b) selected from at least one carboxylic or phosphoric acid, acid amide, ester and multivalent metal salts thereof, each having at least one $C_{12-30}$ alkyl chain and an average particle diameter of 0.1–2.5 μm; and load-bearing particles (c) which are at least one of spherical and elastomeric, with an average particle diameter of 1.2 t–2 t; and wherein the proportions by weight of components a, b and c are given by the formula: b+c/a=0.015 to 0.08.

EXAMPLES

The invention is now illustrated by reference to dyesheets prepared from specific compositions in which the proportions of the lubricating particles and the load bearing particles were varied and the results compared.

Examples 1–6 and Comparative Examples 1' and 2'

In each of these, a backcoat of about 1 μm dry film thickness was obtained by uniformly coating the following backcoat compositions onto one surface of a 6 μm polyester film (Lumirror, Toray product) using a No 3 wire bar, drying for 10 seconds with a dryer, and then curing by irradiation from 15 cm distance using a 80 W/cm ultraviolet beam irradiation apparatus (UVC-254, Ushio product). The values for b and c in the composition were varied from one Example to the next, and the amounts are given in Table 1 below. All quantities are quoted as parts by weight.

| Backcoat composition | |
|---|---|
| Ebecryl 220 | 60 parts |
| isbornyl acrylate | 26 parts |
| Diakon LG 156 | 14 parts |
| zinc stearate (2 μm) | b parts |
| Tospearl 120 | c parts |
| Atmer 129 | 1 part |
| Quantacure ITX | 1.7 parts |
| Quantacure EPD | 1.7 parts |
| Irgacure 907 | 3.4 parts |
| methyl isobutyl ketone | 150 parts |

where: Ebecryl 220 is a 6 functional radical polymerisable urethane acrylate from Daicel UCB), isbornyl acrylate is a monofunctional radical polymerisable compound, Diakon LG 156 is a polymethyl methacrylate product from ICI, Atmer 129 is an antistatic agent from ICI, Tospearl is a polymethyl silsesquioxane silicone resin powder having a mean particle size of 2.0 μm from Toshiba, Quantacure ITX is a photoinitiator from International Biosynthetics, Quantacure EPD is a photosensitizer from International Biosynthetics, and Irgacure 907 is a photoinitiator from Ciba-Geigy On the other side of the substrate was first applied a barrier layer composition of the below-listed components, dried, cured and covered in its turn with a dyecoat composition comprising the components listed below, and dried to form a dyecoat about 1 μm thick.

| Dye-barrier composition | |
|---|---|
| Ebecryl 220 | 70 parts |
| Diakon LG 156 | 10 parts |
| Synocure 861X | 20 parts |
| Quantacure ITX | 1.7 parts |
| Quantacure EPD | 1.7 parts |
| methyl isobutyl ketone | 150 parts |

Synocure 861X is an acrylated polyester polyol having zero radical functionality.

| Thermal transfer printing dyecoat composition | |
|---|---|
| Thermal transfer dye mixture | 5.3 parts |
| PVB (BX1) | 4.7 parts |
| ethyl cellulose (T10) | 1.2 parts |
| tetrahydrofuran | 90 parts |

A receiver sheet was prepared based on a substrate of polyester film (Melinex 990, ICI product) of 100 μm thickness. A dye-receiving layer composition was prepared using the below-listed components, which were the coated onto one face of the substrate using a wire bar No 6, to give a dye-receiving layer of about 4 μm dry film thickness.

| Dye-receiving layer | |
|---|---|
| Vylon 200 | 100 parts |
| Tegomer HSi 2210 | 0.7 " |
| Cymel 303 | 1.4 " |
| Timuvin 900 | 1.0 " |
| p-toluene sulphonic acid | 0.4 " |
| toluene/MEK (60/40) | 1000 |

Tegomer HSi 2210 is a bis-hydroxyalkyl polydimethylsiloxane sold by Goldshmidt, cross-linkable by the Cymel 303 under acid conditions to provide a release system effective during printing. Cymel 303 is a hexamethoxymethylmelamine from American Cyanamid. Nacure 2538 is an amine-blocked p-toluene sulphonic acid catalyst, and Tinuvin 900 is a UV stabiliser.

Samples of each of the dyesheets thus prepared were placed against a receiver sheet with dyecoat and dye-receiving layer in contact, and passed through a number of printers in turn, such that each dyesheet was evaluated for use in each of the printers. The results are summarised in Table 1.

TABLE 1

| | Formulation % w/w | | | Printer Performance | | | |
|---|---|---|---|---|---|---|---|
| | Component | | Haze | Ribbing | | | |
| Example | b | c | % | i | ii | iii | Smiles |
| 1 | 1.5 | 1.0 | 7.8 | 4 | 3 | 4 | none |
| 2 | 3.0 | 0.5 | 9.5 | 4 | 4 | 2 | none |
| 3 | 3.0 | 1.0 | 9.7 | 2 | 2 | 2 | none |
| 4 | 3.0 | 1.5 | 11.5 | 2 | 1 | 1 | none |
| 5 | 4.0 | 0.5 | 10.3 | 3 | 4 | 2 | none |
| 6 | 5.0 | 0.5 | 10.6 | 3 | 4 | 2 | none |
| 1' | 6.0 | 0 | 9.2 | 4 | 5 | 2 | none |
| 2' | 5.0 | 5.0 | >30.0 | 1 | 1 | 1 | none |

In Table 1, the printer performance is assessed by evaluating the ribbing under three different conditions, thus:

i is a width step down, where a full width transverse band of high density is abruptly changed to two spaced narrow bands, repetitions giving a lattice print. Faults show as an unprinted line immediately after each width reduction, ii is a big area of maximum density. Faults show as transverse ribs, and possibly also smiles, iii is a power step down, where after printing a block at full power, an abrupt change to a lower power, half or less, is made. Faults show as a series of transverse ribs, becoming progressively faintar in most cases, and smiles are transverse arcuate areas of low optical density, and these are looked for in areas of maximum density (is ii conditions).

Under "Printer Performance" the lower the number, the better was the performance with respect to ribbing defects, with 1 signifying excellent performance, 2 good, 3 acceptable, 4 fair and 5 poor performance. Example 1' is a comparative Example in which the load-bearing particles are absent, and although the haze values were low, the printing performance suffered, this showing most where large blocks of solid high density colour were required.

Printer compatibility

Different printers may react differently to hazy dyesheets. Some operate without problems, but others may miss some colour repeats. Of the latter, some may stop after failing to detect two repeats, whereas others just fail to print at all. The samples were tested on a number of different commercial printers, some of which we knew to be particularly haze sensitive, and others with which we had previously had no problems.

No such problems were experienced with any of the dyesheets of Examples 1–6 and 1'. Example 2' is a further comparative Example using the same lubricant and load bearing particles, but in sufficient quantity to give a haze value greater than the 12% specified above. Compatibility problems as described above were experienced when using this dyesheet in some, but not all, of the printers tested.

Example 7

In this Example an ultrafine particulate lubricant was used.

| Backcoat composition | |
|---|---|
| Binder resins | 95 parts |
| zinc stearate (ultrafine lubricant) (average particle size 0.2–0.4 μm) | 3 parts |
| KMP-590 (load bearing particles) (average particle size 2.0 μm) | 2 parts |

KMP-590 is a silicone gel sold by Shinetsu Chemicals. The binder resins were essentially as described in the previous Examples, and were similarly crosslinked in situ by free radical polymerisation of the acrylic groups, to give a dry backcoat of about 1 μm thickness.

The haze value was again less than 12%, and no compatibility problems were experienced with any of the printers. Excellent printing performances (value 1 in Table 1 above) were obtained in each of the ribbing tests.

I claim:

1. A dyesheet for thermal transfer printing comprising a thermoplastic substrate film supporting a dyecoat containing a thermal transfer dye on one surface and a heat resistant backcoat on the other, wherein the backcoat comprises the following components:

a) a crosslinked polymeric binder having a thickness t and containing therein a combination of b) lubricating particles and c) load-bearing particles having an average diameter greater than t, and a haze value of less than 12%.

2. A dyesheet as claimed in claim 1 wherein the crosslinked polymeric binder comprises a crosslinked acrylic composition based on one or more polyfunctional organic resins having from 2 to 8 pendent or terminal acrylic or methacrylic groups per molecule available for crosslinking.

3. A dyesheet as claimed in claim 2 wherein the acrylic composition comprises at least one organic compound having a single acrylic or methacrylic group per molecule, which is copolymerised with the polyfunctional acrylic resins in forming the backcoat binder.

4. A dyesheet as claimed in claim 1 wherein the the binder thickness is less than or equal to 2 μm.

5. A dyesheet as claimed in claim 1 wherein the lubricating particles are carboxylic or phosphoric acids, acid amides, esters and their multivalent metal salts, with at least one $C_{12-30}$ alkyl chain.

6. A dyesheet as claimed in claim 5 wherein the lubricating particles are multivalent metal salts of phosphate esters expressed by the following general formulae (A) and (B):

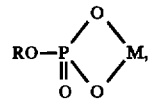

(A)

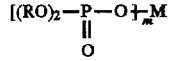

(B)

in which R is an alkyl group of $C_{12-30}$ or an alkylphenyl group, m is an integral number of 2 or 3, and M a metal atom.

7. A dyesheet as claimed in claim 1 wherein the lubricating particles have an average particle diameter of 0.1 to 2.5 μm.

8. A dyesheet as claimed in claim 7 wherein the lubricating particles have an average particle diameter less than 1 μm.

9. A dyesheet as claimed in claim 8 wherein the lubricating particles and the load-bearing particles together are present as 1.5–8% by weight of the binder.

10. A dyesheet as claimed in claim 1 wherein the load-bearing particles comprise spherical particles of silsesquioxane compounds.

11. A dyesheet as claimed in claim 1 wherein the load-hearing particles comprise silicone gel elastomers.

12. A dyesheet as claimed in claim 1 wherein the load bearing particles have an average particle diameter of 1.2 t–2 t.

13. A dyesheet as claimed in claim 1 wherein the lubricating particles and the load-bearing particles together are present as 1.5–6% by weight of the binder.

14. A dyesheet as claimed in claim 1 wherein the backcoat contains the lubricating particles (b) and load bearing particles (c) in the weight ratio (b:c) of 1:1 to 10:1.

15. A dyesheet for thermal transfer printing comprising a thermoplastic substrate film supporting on one surface a dyecoat containing a thermal transfer dye and on the other surface a heat resistant backcoat, wherein the backcoat has a haze value of less than 12% and comprises a crosslinked polymeric binder (a) having a thickness t and containing therein a combination of lubricating particles (b) selected from at least one carboxylic or phosphoric acid, acid amide, ester and multivalent metal salts thereof, each having at least one $C_{12-30}$ alkyl chain and an average particle diameter of 0.1–2.5 μm; and load-bearing particles (c) which are at least one of spherical and elastomeric, with an average particle diameter of 1.2 t–2 t; and wherein the proportions by weight of components a, b and c are given by the formula:

$$b+c/a=0.015 \text{ to } 0.08.$$

16. A method of thermal transfer printing by transferring thermally transferable dyes from a dyesheet to a receiver using a printer having at least one sensor susceptible to excess haze in the dyesheet, wherein the dyesheet has a backcoat with a haze value of less than 12%, and comprises a crosslinked polymeric binder (a) having a thickness t and containing therein a combination of lubricating particles (b) selected from at least one carboxylic or phosphoric acid, acid amide, ester and multivalent metal salts thereof, each having at least one $C_{12-30}$ alkyl chain and an average particle diameter of 0.1–2.5 μm; and load-bearing particles (c) which are at least one of spherical and elastomeric, with an average particle diameter of 1.2 t–2 t; and wherein the proportions by weight of components a, b and c are given by the formula:

$$b+c/a=0.015 \text{ to } 0.08.$$

* * * * *